United States Patent [19]

Bearden, Jr.

[11] 4,076,613

[45] Feb. 28, 1978

[54] COMBINED DISULFURIZATION AND CONVERSION WITH ALKALI METALS

[75] Inventor: Roby Bearden, Jr., Baton Rouge, La.

[73] Assignee: Exxon Research & Engineering Co., Linden, N.J.

[21] Appl. No.: 571,903

[22] Filed: Apr. 28, 1975

[51] Int. Cl.[2] ..... C10G 13/06; B01J 27/04

[52] U.S. Cl. ..... 208/108; 208/112; 208/208 M; 208/209; 208/213; 208/230; 208/254 H; 208/264; 208/288; 252/439; 252/476; 252/477 R; 260/667

[58] Field of Search ..... 208/108, 112, 208 M, 208/215, 208 R, 209, 226, 230, 235; 260/667; 252/476, 477 R

[56] References Cited

U.S. PATENT DOCUMENTS

| | | | |
|---|---|---|---|
| 1,729,943 | 10/1929 | Hofsass | 266/667 |
| 1,938,672 | 12/1933 | Ruthruff | 208/230 |
| 2,034,818 | 3/1936 | Loughrey | 208/142 |
| 3,745,109 | 7/1973 | Heredy et al. | 208/107 |
| 3,751,505 | 8/1973 | Bergomi | 260/672 |
| 3,787,315 | 1/1974 | Bearden et al. | 208/208 M |
| 3,788,978 | 1/1974 | Bearden et al. | 208/208 M |
| 3,975,454 | 8/1976 | Ichikawa et al. | 260/672 |

*Primary Examiner*—Delbert E. Gantz
*Assistant Examiner*—G. E. Schmitkons
*Attorney, Agent, or Firm*—Arnold Krumholz; Edward M. Corcoran

[57] ABSTRACT

Improved processes for the combined desulfurization and hydroconversion of various sulfur-containing petroleum oils, and particularly various residua feedstocks, are disclosed. These feedstocks are thus contacted with alkali metals, such as sodium, in the molten state, in a conversion zone maintained at specified conditions such that the feedstocks are both desulfurized and subjected to significant hydroconversion, particularly demonstrated by significant reductions in the 1,050° F+ fraction of these feedstocks, as well as significantly decreased Conradson carbon and increased API gravity. In addition, the deep demetallization and moderate denitrogenation of these feedstocks is also achieved. These important results are obtained by maintaining the conversion zone at temperatures of above 750° F, and in the presence of sufficient added hydrogen to produce a hydrogen pressure in the conversion zone of between about 1500 and 3000 psig.

18 Claims, 1 Drawing Figure

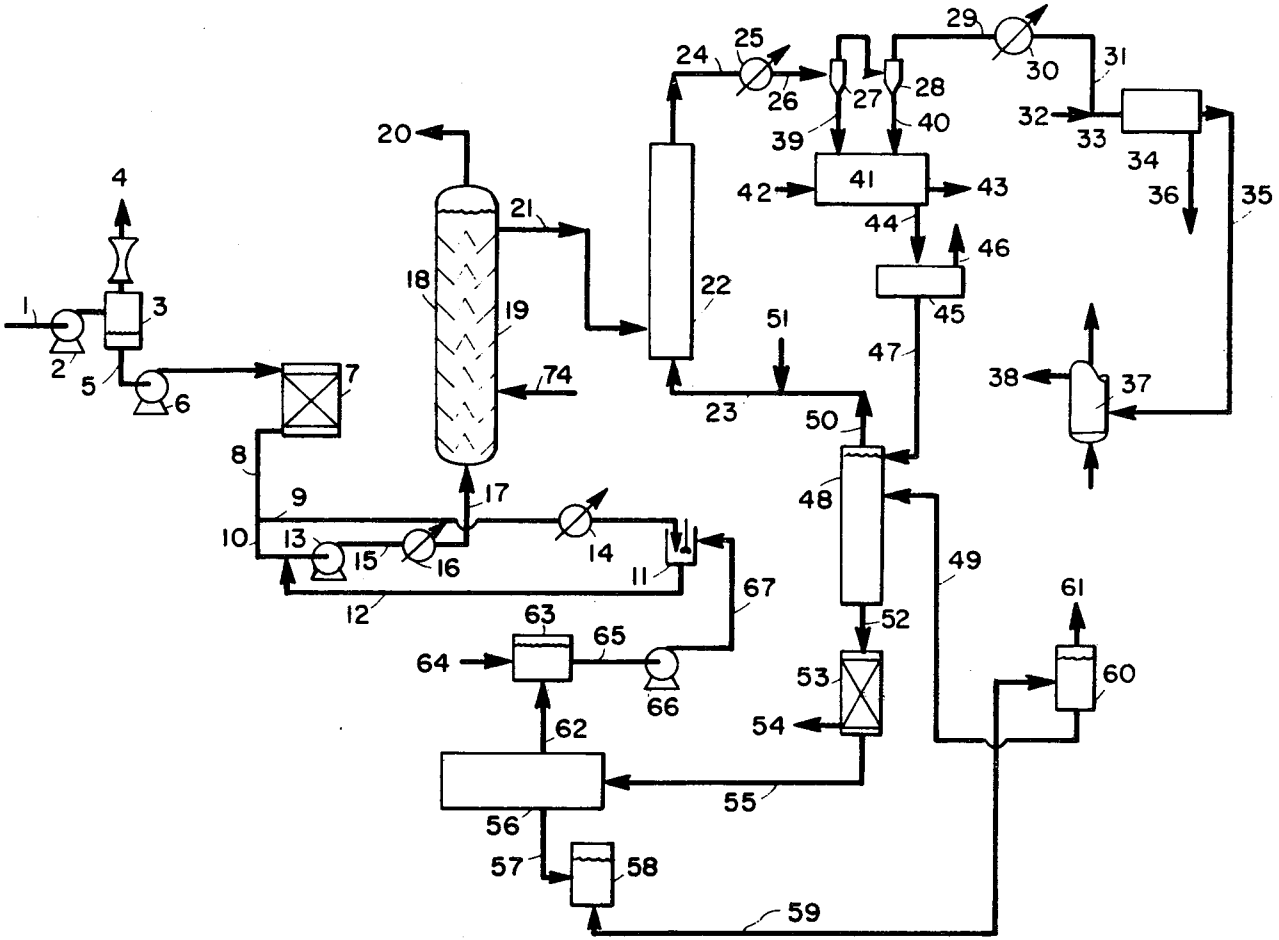
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
74

COMBINED DISULFURIZATION AND CONVERSION WITH ALKALI METALS

FIELD OF THE INVENTION

The present invention relates to processes for the combined desulfurization and conversion of sulfur-containing hydrocarbon feedstocks. More particularly, the present invention relates to processes for the combined desulfurization and hydroconversion of heavy sulfur-containing hydrocarbon feedstocks in the presence of alkali metals. Still more particularly, the present invention relates to such processes for the combined desulfurization and hydroconversion of sulfur-containing heavy hydrocarbon feedstocks in the presence of molten sodium, wherein sodium is regenerated and recycled therein.

DESCRIPTION OF THE PRIOR ART

Because of the large amounts of sulfur-bearing fuel oils which are currently being employed as raw materials in the petroleum refining industry, the problems of air pollution, particularly with regard to sulfur oxide emissions, has become of increasing concern. For this reason, various methods for the removal of sulfur from these feedstocks have been the subject of intensive research efforts by this industry. At present, the most practical means of desulfurizing such fuel oils is the catalytic hydrogenation of sulfur-containing molecules at elevated pressures and temperatures in the presence of an appropriate catalyst.

While these processes are relatively efficient in the case of certain distillate oils, they become less efficient as increasingly heavier feedstocks, such as whole or topped crudes and residua are employed. This generally arises both from the fact that the generally high molecular weight sulfur-containing compounds therein cannot diffuse through the catalyst pores, and further the presence of large amounts of asphaltenes which tend to form coke deposits on the catalyst surface thereby deactivating same. Further, such feedstocks are also contaminated with heavy metals which also tend to deposit on the catalyst surface and deactivate same.

Therefore, as alternative desulfurization processes, alkali metal dispersions, such as sodium dispersions, have been used as desulfurization agents. In such processes, hydrocarbon fractions are contacted with such dispersions, and the alkali metals react with the sulfur to form dispersed sodium sulfide. For example, in U.S. Pat. No. 1,938,672 alkali metals in the molten state are so employed. These processes, however, have suffered from several distinct disadvantages. Specifically, these have included relatively low desulfurization efficiency, due partially to the formation of substantial amounts of organo-sodium salts, the tendency to form increased concentrations of high molecular weight polymeric components, such as asphaltenes, and the failure to adequately remove metal contaminants from the oil. In addition, it has, in the past, been exceedingly difficult to resolve the resultant alkali metal salts-oil mixtures and regenerate alkali metal therefrom. Furthermore, these processes have never been capable of achieving both significant desulfurization and the hydroconversion of the feedstocks being so treated. Recently, however, U.S. Pat. No. 3,788,978 assigned to Exxon Research and Engineering Company, the assignee of the present invention, disclosed a process which included means for resolving the desulfurized oil-alkali metal salt mixtures.

Furthermore, U.S. Pat. No. 3,787,315, also assigned to Exxon Research and Engineering Company, disclosed that such alkali metal desulfurization, when carried out in the presence of low pressure hydrogen, resulted in improved efficiency, whereby less sodium was required in order to remove given amounts of sulfur. Furthermore, improved demetallization, and elimination of sludge formation was obtained. Again, however, these processes do not achieve simultaneous desulfurization and hydroconversion of the hydrocarbon feedstocks employed.

In addition, these above-noted patents assigned to Exxon Research and Engineering Company also teach various methods for regenerating alkali metal from the alkali metal sulfides produced therein, including specific electrolytic and chemical regeneration processes.

SUMMARY OF THE INVENTION

In accordance with the present invention, it has now been discovered that various sulfur-containing hydrocarbon feedstocks, and most significantly various residua feedstocks, can be both desulfurized and upgraded by means of hydroconversion by contacting same in a reaction zone with a desulfurizing agent comprising an alkali metal, when the contacting is carried out at certain specified conditions. Specifically, such contacting is thus carried out in a conversion zone which is maintained at a temperature of at least about 750° F, and in the presence of sufficient added hydrogen to produce a hydrogen pressure in said conversion zone of between about 1500 and 5000 psig which results in significant hydroconversion of the feed, particularly demonstrated by significant reductions in the 1,050° F+ fractions, as well as significantly decreased Conradson carbon and increased API gravity of the hydrogenated products.

In a preferred embodiment, sodium is employed, in a molten state, and the contacting is carried out with a sulfur-containing hydrocarbon feedstock containing at least about 10 weight percent components boiling above about 1,050° F, and containing at least about 1 weight percent sulfur, in a conversion zone maintained at temperatures preferably above about 800° F, and at hydrogen pressures of from about 1500 to 5000 psig, and also wherein from between about 1 to 3 weight percent sodium based upon the hydrocarbon feed present is employed for each percent of sulfur in the feed so that at least about 50 percent of the sulfur in said feedstock is removed, and further so that from between about 20 to 90 weight percent of the 1,050° F+ portion of the feedstream is converted to lower boiling products, preferably at least about 50 weight percent thereof.

In one embodiment of the present invention the alkali metal desulfurizing agent employed, which is converted to alkali metal sulfide during the aforesaid contacting, is separated from the desulfurized and substantially upgraded products withdrawn from the conversion zone, and regenerated and recycled for further use therein. Such regeneration may be accomplished in several manners, preferably by the conversion of the separated alkali metal sulfide to alkali metal polysulfide, and subsequent electrolysis thereof to produce the alkali metal for recycling, or the oil-salt mixture removed from the conversion zone may be pretreated with water and/or hydrogen sulfide prior to such electrolysis to similarly recover and regenerate alkali metal.

DETAILED DESCRIPTION

Various heavy petroleum feedstocks from which sulfur is to be removed may be employed in the present process. Thus, the process is particularly effective when employed for the desulfurization of heavy hydrocarbons, for example those containing residual oils. Preferably, therefore, the process disclosed herein may be employed for the desulfurization and simultaneous hydroconversion of whole or topped crude oils, but most preferably for residua feeds, including both atmospheric and vacuum residua feedstocks, or heavy viscous crudes. Thus, both atmospheric residuum boiling above about 650° and vacuum residuum boiling above about 1,050° F can be treated by the present invention, and such feedstocks may be derived from various crude oils, from various areas of the world, as for example, Safaniya crudes from the Middle East, Laquinillas crudes from Venezuela, various U.S. crudes, etc. Preferably, these feedstocks employed in the present invention are sulfur-bearing heavy hydrocarbon oils containing at least about 1.0 weight percent sulfur, generally above about 3.0 weight percent sulfur, and containing at least about 10 percent materials boiling above 1,050° F, and most generally at least about 40 percent materials boiling above 1,050° F. Specific examples of feedstocks applicable to the present process include Safaniya Atmospheric Residuum, Jobo Crube, Athabasca Bitumen, Safaniya Vacuum Residuum and other heavy carbonaceous feedstocks.

While these feeds may be introduced directly into the conversion zone for combined desulfurization and hydroconversion without pretreatment, it is preferred to desalt the feed in order to prevent sodium chloride contamination of the sodium salts which are produced during processing in the conversion zone. Such desalting is a well-known process in the refining industry, and may generally be carried out by the addition of small amounts of water to the feedstock to dissolve the salts, followed by the use of electrical coalescers. The oil may then be dehydrated by conventional means well known in this industry.

The alkali metals which may be employed for the present process generally include the metals contained in Group IA of the Periodic Table of the Elements, including lithium, sodium, potassium, rubidium and cesium. Sodium, however, is the most preferred alkali metal for use herein.

The alkali metal, e.g. sodium, may be used as a dispersion of the pure metal. Further, it is also considered that sodium or alkali metal alloys, e.g. sodium-lead alloys, can be used as the treating agent, as disclosed in U.S. Pat. No. 3,787,315, which teaches sodium treating petroleum stocks with low pressure hydrogen present. This portion of U.S. Pat. No. 3,787,315 is therefore incorporated herein by reference thereto.

The conditions under which the alkali metal is contacted with the particular sulfur-containing feedstock described above is carried out is critical to obtaining the results which may be achieved by employing the present invention. That is, the reaction temperatures of greater than about 750° F, preferably greater than about 800° F and most preferably between about 800° and 900° F must be employed. Furthermore, it is also essential that specific elevated hydrogen pressures be employed within the reaction zone, generally above about 1500 psig, preferably between about 1500 and 5000 psig, more preferably between about 1500 and 3000 psig, and most preferably between about 2000 and 2500 psig.

Reference is thus made to the August 1973 article entitled "Reactions of Phenanthrene and Anthracene in Thermal High Pressure Hydrogenolysis", by Messrs. Penninger and Slotboom, appearing in "Erdoel und Kohle-Erdgag-Petrochemie Vereinlgt mit Brennstoff-Chemie, Bd. 26, Heft. 8, p. 447 (1973)", in which the need for high temperatures to disrupt polynuclear aromatic structures is shown. Thus, the authors showed that at temperatures of above about 880° F, and at hydrogen pressures of 1200 psig the dominant reaction was coking. With respect to the present invention, it has been discovered that at the specific elevated temperature and pressure conditions disclosed herein both high degrees of desulfurization and the hydroconversion described above may be obtained, without increased coking. The amount of alkali metal such as sodium employed in the conversion zone will depend upon the sulfur content of the feed. Specifically, where feedstocks containing from about 2 to 3 weight percent sulfur are employed, from about 1.5 to 3 weight percent sodium based on the total feedstock may be employed, and where sulfur-containing feedstocks including from about 4 to 5 weight percent sulfur are employed, from about 3 to 6 weight percent sodium based on the total feedstock present may be employed. More specifically, the mole ratio of sodium (alkali metal) to sulfur is held in the range of from about 1 to 3, preferably from about 2.0 to 2.8. It has thus been found that the use of more sodium than specified in the above ranges produces an undesirable polymeric coke from the residua nitrogen compounds at the conditions employed herein.

As for the hydrogen required in this process, it can be introduced into the conversion zone either as pure hydrogen, as an example that from a steam reforming process, or as diluted hydrogen gas streams, such as discarded refinery streams produced in hydrotreating processes, etc.

Contacting in the conversion zone to effect simultaneous desulfurization and hydroconversion may be conducted as either a batch or continuous operation, but continuous operation is obviously preferable. In addition, the staged treating of the feed with successive additions of fresh reagent may be employed.

The petroleum oil feedstock and the sodium or other alkali metal can be passed through one or more reactors in concurrent, cross-current, or counter-current flow, etc. It is preferable that oxygen and water be excluded from the reaction zone; therefore, the reaction system is thoroughly purged with dry nitrogen and the feedstock dried prior to introduction into the reactor. It is understood that trace amounts of water, i.e. less than about 0.5 weight percent, preferably less than about 0.1 weight percent based on total feed, can be present in the reactor. When there are larger amounts of water, process efficiency will be lowered somewhat as a consequence of sodium reacting with the water. The resulting oil dispersion is subsequently removed from the desulfurization and hydroconversion zone, and the alkali metal or sodium may then be regenerated and recovered for recycling in the manner described below. Initially, the oil dispersion is contacted with either water or hydrogen sulfide, prior to electrolysis thereof for the regeneration of sodium, to facilitate separation of salts from the oil.

Specifically, reference is now made to the disclosure in U.S. Pat. No. 3,787,315, beginning at column 5, line 40 thereof, with regard to treatment of the oil-salt mixture with water, in order to separate the alkali metal salts from the product oil stream prior to electrolysis, and also the disclosure contained at column 7, lines 27 ad seq thereof with regard to the alternative contacting of the oil-salt mixture with hydrogen sulfide for such purposes. In addition, in either case, alkali metal or sodium is then regenerated by use of an electrolytic cell, as described beginning at column 9 of the aforesaid U.S. Patent. All of these disclosures, i.e. relating to water or hydrogen sulfide treatment of the oil-salt mixture for separation thereof, and use of an electrolytic cell for the regeneration of alkali metal or sodium are thus incorporated herein by reference thereto.

DESCRIPTION OF THE DRAWING

The FIGURE is a schematic flow diagram of the combined desulfurization and hydroconversion process according to the present invention, including regeneration.

Referring to the FIGURE, a sulfur-containing feedstock, preheated to 450°-500° F., is fed by means of line 1 and pump 2 to separator vessel 3 where trace amounts of water and light hydrocarbon fractions are removed through line 4. The feed is then discharged through line 5 by pump 6 to filter vessel 7 wherein particulate matter, i.e., coke, scale, etc. is removed.

The feed is preliminarily desalted by conventional means (not shown). Feed exiting the filter via line 8 is split into two streams. A small portion is fed through line 9 and heat exchanger 14 to dispersator vessel 11 where a dispersion is formed with sodium entering through line 67. The dispersator vessel is of a conventional design and is operated at 250°-300° F. at atmospheric pressure. The vessel is blanketed with hydrogen. The resultant dispersion, drawn through line 12, blends with the balance of the feed in line 10 and enters the charging pump 13, where the pressure is raised to about 2000 psig.

The oil enters heat exchanger 16 via line 15 where the temperature is raised to about 750° F to 800° F and is then fed through line 17 to reactor vessel 18. The reactor contains baffles 19 to promote continuing contact between sodium and the oil and to prevent by-passing from the inlet to the outlet. Hydrogen is introduced into the reactor vessel 18 via line 74 in amounts such that the total partial pressure of hydrogen in the reactor ranges between about 1800 and 2000 psig. Holding time in the reactor is about 15 to 120 minutes and is preferably about 60 minutes. The temperature at the top of reactor 18 is about 870°. Gas that is formed due to the increase in temperature and excess hydrogen is taken overhead through line 20 and is condensed and depressurized by conventional means (not shown). The desulfurized oil containing dispersed sodium sulfide and other salts leaves the top of reactor 18 via line 21.

Sodium sulfide-oil dispersion, previously depressured to about 200 psig in a stripping tower (not shown) is introduced via line 21 into contacting vessel 22 wherein the dispersion is contacted with about 30 to 80 mole percent hydrogen sulfide based on the total moles of salts contained in the oil, at a temperature between about 600° F and 800° F preferably between about 700° F and 780° F. The pressure is maintained between about 200 and 400 psig. Hydrogen sulfide is introduced into said contactor via line 23. Residence time in the contactor vessel is on the order of about 10 minutes, although longer or shorter times may be used if desired.

The $H_2S$-treated dispersion exits through line 24 at about 720° F and from 200 to 300 psig, and is then cooled to about 450° F in heat exchanger 25. The mixture is then fed through line 26 to hydroclone vessels 27 and 28 in series to disengage the oil-salt mixture. Alternatively, by maintaining the $H_2S$-treated mixture above about 700° F it is possible to disengage from the oil a molten layer of sodium hydrosulfide in a liquid-liquid separator (not shown). Desulfurized oil is then withdrawn via line 29 to heat exchanger 30 and exits at from 250° F to 300° F through line 31. An acid, such as dilute sulfuric acid or acetic acid, may be injected into line 31 through line 32 to react with oil-soluble sodium salts, e.g., sodium mercaptides and the like, and the resultant mixture enters the electrostatic precipitator 34 via line 33. The acidic aqueous phase from vessel 34 is withdrawn through line 36 and discarded. Desulfurized oil is fed through line 35 to steam stripper 37 and subsequently to storage via line 38.

Oil-salt slurry withdrawn from the hydroclone vessels through lines 39 and 40 is fed to wash vessel 41 where a light hydrocarbon wash, entering through line 42, is used to remove heavy adhering oil. The wash effluent is drawn off through line 43 and is eventually fractionated to recover the desulfurized oil content and the light hydrocarbon. The wash vessel operates at from about 50 to 200 psig and at temperatures of from about 200° F to 250° F. A slurry of washed solids is fed through line 44 to drier 45 to remove light hydrocarbons which are taken off through line 46.

Dry solids are fed to blending vessel 48 via line 47, wherein contact is made with sulfur-rich polysulfide $Na_2S_x$, where $x$ ranges from about 4.4 to 4.8, which enters the blending vessel 48 through line 49. The contacting is conducted at a temperature of from about 600° F to 700° F preferably from about 600° F to 650° F, and at a pressure between about atmospheric pressure and 100 psig, preferably between atmospheric pressure and 50 psig. Hydrogen sulfide released in the blending reaction along with some small amount of light hydrocarbon is removed through line 50, blended with makeup hydrogen sulfide entering from line 51 and is recycled to vessel 22 by way of line 23.

The molten sulfur depleted polysulfide ($Na_2Sy$, where $y$ ranges from about 3.5 to 4.2, as described in U.S. Pat. No. 3,787,315) is removed from blending vessel 48 through line 52 and fed to filter vessel 53 to remove particulate matter such as coke and melt insoluble salts. Line 54 is used to purge a small stream of sodium polysulfide from the system in order to prevent buildup of impurities to an inoperable level.

These dissolved impurities arise from the feed and from equipment corrosion as well as from the organometallic compositions removed from the feed by the action of sodium. Specifically, compounds containing combined iron, vanadium, silica, nickel, chromium, lead and tin may form and are removed from the system via line 54.

The filtered, purged sulfur-depleted sodium polysulfide, $Na_2Sy$, is introduced into cell 56 via line 55.

A dry nitrogen stream (not shown) blankets the electrolytic cells. The electrolytic cells are of a conventional design and may comprise any cell capable of converting the polysulfide to sodium metal. Preferably, the individual cell unit comprises a molten sodium-containing cavity and a molten sodium polysulfide-containing cavity separated from each other by a sodium ion-permeable membrane comprising preferably crystalline beta-alumina as described in U.S. Pat. No. 3,787,315, at column 10 thereof. Again, the specific details regarding the electrolytic cell employed, as contained in the above-noted U.S. Patent, are again incorporated herein by reference. Finally, the sodium polysulfide, $Na_2S_z$ where $z$ ranges from about 4.8 to 5.2, which is formed in the electrolytic cell 56 is passed via line 57 to surge vessel 58 and then to sulfur-reducing vessel 60 which is partially evacuated, e.g. to an absolute pressure of from about 10 to about 300 mm Hg, preferably from about 50 to about 100 mm Hg, to vaporize some of the sulfur and reduce the sulfur content of the polysulfide so that the final polysulfide composition is $Na_2S_x$ where $x$ takes values ranging from about 4.0 to about 4.9, preferably from about 4.4 to about 4.8.

At one-tenth atmosphere sulfur vapor pressure, for example the composition in equilibrium therewith is approximately $Na_2S_{4.82}$ at 700° F, $Na_2S_{4.73}$ at 750° F and $Na_2S_{4.64}$ at 800° F. The sulfur vapor is taken overhead through line 61 and condensed by conventional means (not shown). As indicated previously the resulting polysulfide is then recycled via line 49 to scrubbing tower 48. Alternatively, at least a portion of the sodium polysulfide stream exiting from the cell can be contacted directly with the $H_2S$-treated salt mixture, thereby bypassing the evacuating operation in vessel 60. Thus, for example $Na_2Sy$ exiting from the cell can be contacted directly with the $H_2S$-treated salt mixture. The molten sodium is subsequently removed from the electrolytic cell and passed via line 62 to surge vessel 63 where it is blended with makeup sodium entering at line 64 and then fed via line 65, pump 66 and line 67 to vessel 11.

While the preferred embodiment shown in the FIGURE is thus directed to the use of hydrogen sulfide treatment of the oil-salt mixture, it is also understood that the water treatment step shown in the above-described U.S. Pat. No. 3,787,315 may also be alternatively employed.

PREFERRED EMBODIMENTS

The present process may be further understood by reference to the following examples thereof.

Example 1

The combined desulfurization, hydroconversion, demetallization, and denitrogenation of a Safaniya atmospheric residuum feedstock as shown in Table I was carried out employing sodium metal. The results obtained, and the process conditions employed, are contained in Table II hereof.

These results clearly demonstrate the effectiveness of the sodium employed not only for deep desulfurization of the sulfur-containing feedstock employed, but also for the hydroconversion, partial denitrogenation, and demetallization thereof. Thus, approximately 98% of the sulfur content of the feedstock was removed therefrom, while at the same time Conradson carbon losses of almost 70% were obtained, along with almost quantitative metals removal. Additionally, API gravity increases from 14.4 to 27 and 28.1 were achieved. Finally, about 75% of the 1,050° F+ fraction of the feedstock employed was converted to lower boiling products.

EXAMPLE 2

In order to compare the improved results for desulfurization, hydroconversion, partial denitrogenation and demetallization shown in Example 1 with similar processes carried out outside the ranges of preferred conditions forming the essence of the present invention, several additional runs were carried out employing the same Safaniya atmospheric residuum feedstock described in Table I. These results, and the process conditions employed in each, are contained in Table III hereof.

Run #3 shown in Table III represents a typical desulfurization run carried out according to the prior art, such as for example U.S. Pat. No. 3,787,315. This desulfurization run, carried out at a moderate temperature of 650° F, and under a low hydrogen pressure of 200 psig, does result in the excellent desulfurization of a residua feedstock, with some concurrent hydrogen up-take. Reaction times of from 0.5 to 2.0 hours have been tested, and it has been shown that little if any change occurs after a 1.0 hour contact in the temperature ranges shown in the afore-mentioned patent, namely, from about 600° to 730° F. In view of the amount of hydrogen so consumed, which is generally found to be roughly one mole per mole of sulfur removed from the oil, there is a strong indication that the hydrogenation reaction and desulfurization reaction are related according to the following equation:

$$RSR + 2Na \rightarrow 2R. + Na_2S$$

$$2R. + H_2 \rightarrow 2RH$$

where

R. = hydrocarbon radical.

Thus, any conversion which occurs during this reaction merely derives from the fragmentation of sulfur-bearing molecules, with the hydrogen acting to heal the organic radicals so produced. For this reason any conversion which occurs is relatively constant for most 650° F+ residua feeds, generally averaging about 15 to 20% reduction in a given feeds' 1,050° F+ bottoms fraction. The amount of hydrogen thus consumed amounts to approximately 12 SCF per pound of sulfur removed or about 120 to 150 SCF/B when Safaniya type feeds are processed to approximately 0.3% sulfur content products.

As shown in Run #4, under a higher hydrogen pressure of 1200 psig, and temperatures in the 700° to 730° F range, very little additional conversion of 1,050° F+ bottoms is observed, although additional hydrogen uptake is demonstrated. Runs #5 and #6 were carried out at higher temperatures, namely those within the range of the present invention, while hydrogen pressures of 1750 psig, i.e. somewhat below that required by the present invention, were employed. Extensive cracking was obtained, in large part derived from hydrocracking. Thus, the 1,050° F+ fraction of the feed was reduced by about 80%, and there was extensive overall conversion of the feed. Hydrogen consumption in these Runs was higher than that obtained under the hydrofining conditions employed in Run #4, but the amount of hydrogen was still not sufficient to impart stablility to the cracked liquid product, it was thus found that these liquid products developed sludge after standing for several days, as was the case in Run #7. Such sludging causes serious process problems in terms of line-plugging, fouling of process control devices, fouling of heat exchanger, etc.

All of these Runs may thus be compared with Runs #1 and #2 in Example 1, wherein none of these deficiencies, and the extremely significant desulfurization, hydroconversion and demetallization were achieved.

Furthermore, referring to Runs #8 and #9, the sodium to sulfur mole ratio concentration was varied between about 1.0 and 2.6. The results indicate that at above about a ratio of 2.6 polymeric coke products are formed, and that below about a ratio of 1.2 producing less than about 60% desulfurization, hydrocracked products forming large amounts of sludge are obtained.

EXAMPLE 3

To further demonstrate the scope of the present invention, particularly with respect to very refractory hydrocarbon feedstocks, the process of the present invention was carried out upon various vacuum residua and bitumen feedstocks as shown in Table IV. Again it is evident that by employing the preferred conditions of temperature, hydrogen pressure and sodium concentration it is possible to achieve excellent desulfurization, demetallization and conversion of heavy components (as indicated by reduced Conradson Carbon content and 1,050° F+ boiling materials) without substantial loss of feed to coke or light ($C_5^-$) gases.

TABLE I

FEEDSTOCK INSPECTION OF SAFANIYA ATMOSPHERIC RESIDUUM EMPLOYED IN EXAMPLE 1

| | |
|---|---|
| API Gravity | 14.4 |
| Sulfur, Wt. % | 3.91 |
| Nitrogen, Wt. % | 0.26 |
| Carbon, Wt. % | 84.42 |
| Hydrogen, Wt. % | 11.14 |
| Oxygen, Wt. % | 0.27 |
| Conradson Carbon, Wt. % | 11.8 |
| Ash, Wt. % | — |
| Water, Karl Fisher, Wt. % | — |
| Metals, ppm | |
| Ni | 20 |
| V | 77 |
| Fe | 4 |
| Viscosity | |
| VSF 122° F. | 235 |
| 140° F. | 131 |
| 210° F. | — |
| Pour Point, ° F | 33 |

TABLE I-continued

FEEDSTOCK INSPECTION OF SAFANIYA ATMOSPHERIC RESIDUUM EMPLOYED IN EXAMPLE 1

| | |
|---|---|
| Naphtha Insolubles, Wt. % | 7 |
| Distillation | |
| IBP, ° F | 464 |
| 5% | 569 |
| 10% | 632 |
| 20% | 724 |
| 30% | 806 |
| 40% | 883 |
| 50% | 962 |
| 60% | 1037 |
| 70% | |
| 80% | |
| 90% | |
| 95% | |
| FBP | 1035 |
| % Rec. (Wt. % 1050⁻) | 59.2 |
| % Res. (Wt. % 1050+) | 40.8 |

TABLE II

DESULFURIZATION AND HYDROCONVERSION OF SAFANIYA ATMOSPHERIC RESIDUA WITH SODIUM

| | Run #1 | Run #2 |
|---|---|---|
| Reactor Conditions | | |
| Time, minutes | 50 | 30 |
| Temp., ° F | 826 | 830 |
| $H_2$ Pressure, psig | 1960 | 1960 |
| Na/S Atom Ratio | 2.2 | 2.2 |
| $H_2$ used, SCF/B | ~ 760 | ~ 650 |
| Products, Wt.% | | |
| $C_5$-Gas | 2.2 | 1.3 |
| Coke | 2.0 | 2.2 |
| Liquid | ~ 91.5 | 92.2 |
| Liquid Inspections | | |
| Sulfur, Wt.% | 0.2 | 0.2 |
| Nitrogen, Wt.% | 0.2 | — |
| Conradson Carbon, Wt.% | 3.7 | — |
| Ni/V/Fe, ppm | < 1, all | 2/1/1 |
| API Gravity | 28.1 | 27 |
| Vol.% 1,050° F | ~ 90 | — |
| Storage Behavior | | |
| Pepper Sludge | None | None |
| Precipitate (1-5 vol.%) | None | None |

TABLE III

DESULFURIZATION AND HYDROCONVERSION OF SAFANIYA ATMOSPHERIC RESIDUA WITH SODIUM

| | Run #3 | Run #4 | Run #5 | Run #6 | Run #7 | Run #8 | Run #9 |
|---|---|---|---|---|---|---|---|
| Reactor Conditions | | | | | | | |
| Time, Minutes | 90 | 60 | 60 | 50 | 45 | 50 | 25 |
| Temp., ° F. | 650 | 700 | 830 | 830 | 825 | 823 | 820 |
| $H_2$ Pressure, psig | 200 | 1200 | 1750 | 1750 | 1500 | 1750 | 1400 |
| Na/S Atom Ratio | 2.9 | 2.4 | 2.2 | 2.0 | 2.3 | 1.2 | 2.6 |
| $H_2$ Used, SCF/B | 130 | 406 | 580 | 530 | 500 | 510 | 365 |
| Products, Wt. % | | | | | | | |
| $C_5$-Gas | — | Nil | 3.0 | 3.3 | 2.7 | 3.8 | 0.7 |
| Coke | Nil | 1.0 | 2.0 | 2.3 | 4.4 | 2.3 | 5.7 |
| Liquid | 95 | 94 | 90.7 | 90.8 | 84 | 89.6 | 89.3 |
| Liquid Inspections | | | | | | | |
| Sulfur, Wt. % | 0.3 | 0.12 | 0.2 | 0.5 | 0.46 | 1.65 | 0.07 |
| Nitrogen, Wt. % | 0.3 | 0.23 | 0.2 | — | 0.56 | — | 0.1 |
| Con. C, Wt. % | — | 5 | 4 | 4.6 | 7.7 | — | 1.35 |
| Ni/V/Fe, ppm | 21/20/4 | 5/12/2 | 4/0/0 | 4/1/1 | 4/4/0 | 13/0/3 | 2/1/4 |
| API Gravity | 20.9 | 21.1 | 29.5 | 28.6 | 23.4 | 26.4 | 26.2 |
| Vol. % 1,050° F− | 65 | 68 | 92 | 90 | 85 | 87 | — |
| Storage Behavior | | | | | | | |
| Pepper Sludge | None | None | Yes | Yes | Yes | Yes | Yes |
| Precipitate (1-5 Vol. %) | None | None | None | None | Slight | Yes | — |

TABLE IV

SODIUM HYDROCONVERSION RESULTS

| | Run #10 | Run #11 | Run #12 |
|---|---|---|---|
| Feed | Safaniya V.R. | Aramco V.R. | GCOS Bitumen |
| Reactor Conditions | | | |
| Time, Minutes | 60 | 60 | 60 |
| Temp., ° F. | 820 | 820 | 820 |

TABLE IV-continued

| SODIUM HYDROCONVERSION RESULTS | Run #10 | | Run #11 | | Run #12 | |
|---|---|---|---|---|---|---|
| $H_2$Pressure, psig | 2000 | | 1700 | | 1675 | |
| Na/S Mole Ratio (Na Wt. % on Feed) | 2.2 (8.2) | | 2.5 (6.9) | | 2.5 (8.0) | |
| $H_2$Used, SCF/B | ~ 500 | | ~ 450 | | ~ 570 | |
| Products, Wt. % | | | | | | |
| $C_5$- Gas | 4.8 | | 1.0 | | 7.2 | |
| $C_5$- 640° F | 5.0 | | 7.8 | | 9.2 | |
| 640+° F | 80.9 | | 81.3 | | 71.7 | |
| Coke | 1.0 | | 3.4 | | 1.0 | |
| Material Balance (Wt. % on Feed) | 96.4 | | 93.3 | | 91.8 | |
| Product Inspections | Feed | Product | Feed | Product | Feed | Product |
| S, Wt. % | 5.20 | 0.3 | 4.01 | 0.2 | 4.49 | 0.4 |
| Con. Carbon, Wt. % | 23.7 | 14.9 | 20.9 | 7.7 | 12.3 | 5.6 |
| Metals, ppm | 224 | 9 | 104 | 1 | 642 | 4 |
| API Gravity | 4.6 | 21.6 | 6.9 | 20.7 | 10.3 | 24.8 |
| 1050−, Wt. % | ~5 | 80 | — | 75 | 58 | 90 |
| Asphaltenes, Wt. % | 30.9 | 3.4 | | 2.5 | | |
| Summary | | | | | | |
| Desulfurization, % | 93.7 | | 96.3 | | 90.4 | |
| Con. Carbon Removal, % | 37.1 | | 63.2 | | 54.5 | |
| Demetallization,% | 96.4 | | 100 | | 99.4 | |
| Na Efficiency, % | 85 | | 80 | | 72 | |
| 1050° F+Conv., % (Approximate) | 78 | | — | | 76 | |

What is claimed is:

1. A process for the combined desulfurization and hydroconversion of a heavy, sulfur-containing hydrocarbon feedstock at least 10 weight % of which boils above about 1050° F, which comprises contacting said feedstock with a metal selected from the group consisting of the alkali metals and alloys thereof, in a conversion zone, said conversion zone being maintained at a temperature above about 750° F and in the presence of sufficient added hydrogen to produce a hydrogen partial pressure of at least about 2000 psig and wherein said alkali metal is present in said conversion zone in an amount such that the alkali metal to feed sulfur mole ratio is maintained at between about 1.0 and 3.0, whereby the sulfur content of said feedstock is reduced by at least about 50 weight %.

2. The process of claim 1 wherein the temperature in said conversion zone is between about 800° and 850° F.

3. The process of claim 1 wherein the hydrogen pressure maintained at said conversion zone is between about 2000 and 2500 psig.

4. The process of claim 1 wherein at least about 50 weight percent of said 1,050° F.+ materials are converted to lower boiling materials in said conversion zone.

5. The process of claim 1 wherein said alkali metal comprises sodium.

6. The process of claim 5 wherein the sodium to feed sulfur mole ratio is maintained in said conversion zone at between about 2.0 and 2.8.

7. A process for the combined desulfurization and hydroconversion of a sulfur-containing residuum feedstock containing at least about 10 weight % materials boiling above about 1,050° F, which comprises contacting said feedstock with a metal selected from the group consisting of the alkali metals and alloys thereof, in a conversion zone, said conversion zone being maintained at a temperature of above about 750° F and in the presence of sufficient added hydrogen to produce a hydrogen pressure of at least about 2000 psig and wherein said alkali metal is present in said conversion zone in an amount such that the alkali metal to feed sulfur mole ratio is maintained at between about 1.0 and 3.0, whereby at least about 50 weight % of said materials boiling above 1,050° F are converted to lower boiling products, whereby the sulfur content of said feedstock is reduced by at least about 50 weight % and further wherein said alkali metal is at least partially converted to alkali metal sulfide in said conversion zone.

8. The process of claim 7 including the regeneration of an alkali metal from said alkali metal sulfide.

9. The process of claim 8 including separating said alkali metal sulfide from the products withdrawn from said conversion zone, contacting said alkali metal sulfide sequentially with hydrogen sulfide and a sulfur rich polysulfide in order to produce a sulfur depleted alkali metal polysulfide, and further wherein said alkali metal is regenerated from said alkali metal polysulfide by the electrolytic decomposition of said sulfur depleted alkali metal polysulfide.

10. The process of claim 7 wherein said alkali metal comprises sodium.

11. The process of claim 10 wherein the sodium to feed sulfur mole ratio in said conversion zone ranges between about 2.0 and 2.8.

12. The process of claim 7 wherein said feedstock contains a substantial amount of metals, and wherein at least about 60 percent of said metals are removed during said contacting in said conversion zone.

13. The process of claim 5 wherein the metal is a sodium-lead alloy.

14. The process of claim 11 wherein the metal is a sodium-lead alloy.

15. The process of claim 6 wherein a liquid product is produced whose Conradson carbon content is 35 to 100 weight percent lower than that of the feedstock.

16. The process of claim 12 wherein a liquid product is produced whose Conradson carbon content is 35 to 100 weight percent lower than that of the feedstock.

17. The process of claim 7 wherein the hydrogen pressure maintained in said conversion zone ranges between about 2000 and 2500 psig.

18. The process of claim 11 wherein the temperature in said conversion zone is maintained at between about 800° and 900° F.

* * * * *